US005425594A

United States Patent [19]

Krage et al.

[11] Patent Number: 5,425,594

[45] Date of Patent: Jun. 20, 1995

[54] ROADSIDE BARRIER

[75] Inventors: William G. Krage, Fair Oaks; John LaTurner, Carmichael; Jeffrey Thompson, Roseville; James Welch, Placerville, all of Calif.

[73] Assignee: Energy Absorption Systems, Inc., Chicago, Ill.

[21] Appl. No.: 174,626

[22] Filed: Dec. 28, 1993

Related U.S. Application Data

[63] Continuation-in-part of Ser. No. 944,459, Sep. 14, 1992, abandoned.

[51] Int. Cl.[6] ..... E01F 15/00

[52] U.S. Cl. ..... 404/6; 256/13.1

[58] Field of Search ..... 404/6, 7, 9; 256/1, 256/13.1, 19; 52/2.11

[56] References Cited

U.S. PATENT DOCUMENTS

| | | | |
|---|---|---|---|
| 3,141,655 | 7/1964 | Platt . | |
| 3,284,122 | 11/1966 | Rich . | |
| 3,503,600 | 3/1970 | Rich . | |
| 3,540,699 | 11/1970 | Guzzardella . | |
| 3,572,465 | 3/1971 | Olson . | |
| 3,661,359 | 5/1972 | Walker . | |
| 3,672,657 | 6/1972 | Young et al. . | |
| 3,856,268 | 12/1974 | Fitch . | |
| 3,872,636 | 3/1975 | Nicosia | 52/600 X |
| 4,138,095 | 2/1979 | Humphrey . | |
| 4,553,875 | 11/1985 | Casey | 256/13.1 X |
| 4,681,302 | 7/1987 | Thompson | 256/13.1 |
| 5,104,254 | 4/1992 | Durand | 404/6 |
| 5,123,773 | 6/1992 | Yoduck | 404/6 |

FOREIGN PATENT DOCUMENTS

| | | |
|---|---|---|
| 388006B | 4/1989 | Austria . |
| 0351572A2 | 1/1990 | European Pat. Off. . |
| 0564393A1 | 10/1993 | European Pat. Off. . |
| 2457344 | 5/1980 | France . |

*Primary Examiner*—Ramon S. Britts
*Assistant Examiner*—James A. Lisehora
*Attorney, Agent, or Firm*—Willian Brinks Hofer Gilson & Lione

[57] ABSTRACT

An energy absorbing roadside barrier includes an elongated container configured to receive and hold a volume of water. The container defines a pair of sidewalls having sufficient rigidity to stand alongside a roadway and sufficient resilience to deform upon an impact by a vehicle and to recover their shape after at least some impacts. The barrier also includes an internal frame positioned within the container. The frame includes first and second axial braces positioned adjacent respective sidewalls of the container, and the axial braces are secured together by at least one cross brace. The frame and container are formed of different materials, and the frame increases the rigidity of the barrier and strengthens the barrier against bending.

24 Claims, 7 Drawing Sheets

Fig. 5
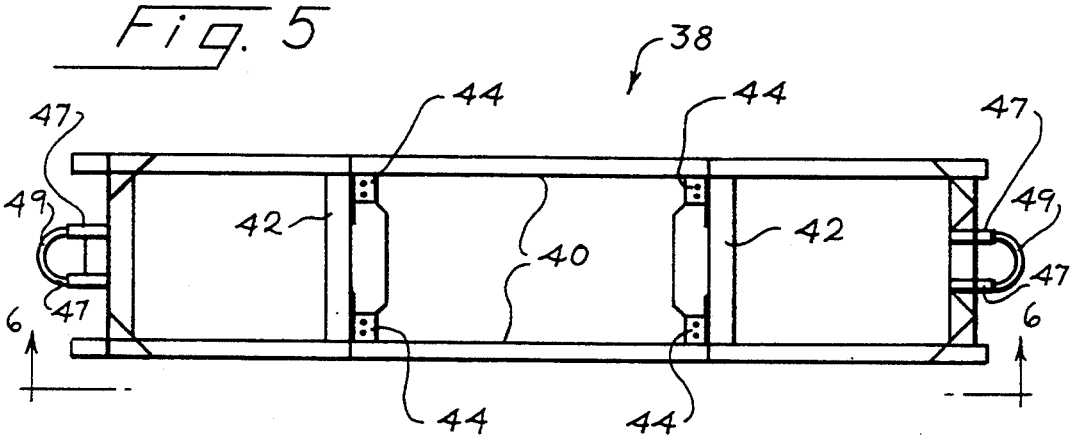
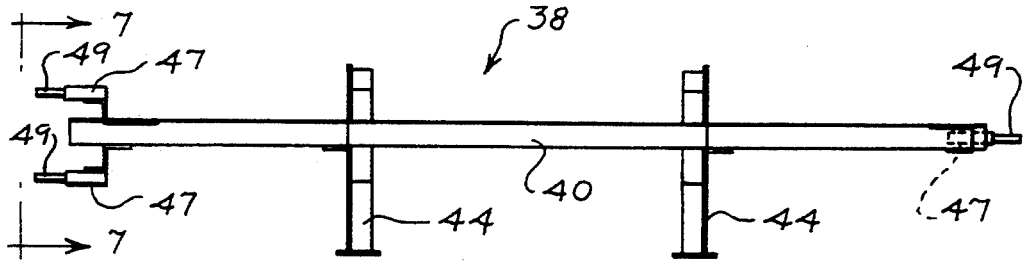
Fig. 6
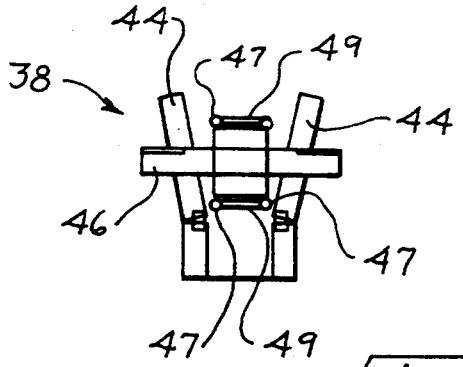
Fig. 7

ROADSIDE BARRIER

This application is a continuation-in-part of application Ser. No. 07/944,459, filed Sep. 14, 1992, now abandoned.

BACKGROUND OF THE INVENTION

This invention relates to roadside barriers of the type having an elongated container configured to receive and hold a volume of fluent material, wherein the container includes a pair of sidewalls having sufficient rigidity to allow the container to stand alongside a roadway and sufficient resilience to deform upon an impact by a vehicle and to recover their shape after at least some impacts.

U.S. Pat. No. 4,681,302 to Thompson, assigned to the assignee of the present invention, describes an energy absorbing roadside barrier of the type described above. The disclosed barrier includes a water filled plastic container that defines an array of ridges and channels along each side. Adjacent barriers are interconnected by overlapping mounting elements which receive vertically oriented pins.

The water contained by the barrier provides mass while allowing the barrier to deform in an impact. The sidewalls of the barrier are shaped to reduce friction with the tire of an impacting vehicle, and the plastic material from which the barrier is formed is selected to have a low coefficient of friction. These features combine to reduce the tendency of an impacting vehicle to climb the barrier during the impact.

Actual testing has shown the barrier described in the above-identified Thompson patent to be effective in many applications. However, the disclosed barrier does have certain drawbacks. Since the container itself utilizes plastic materials to define the structure of the container, such barriers have in the past been formed of relatively expensive plastic materials such as cross linked polyethylene. Even when such expensive materials are used, the length of the barrier has been limited, to 5 feet in one example. This increases the number of barriers required for any particular application, and the overall cost. The weight of the barrier when empty should be kept as low as possible to facilitate use.

Accordingly, it is an object of this invention to provide an improved energy absorbing barrier which is light in weight, and which can be built at lower cost using less expensive materials that allow a barrier of greater length to be used.

SUMMARY OF THE INVENTION

According to this invention, a roadside barrier of the type described initially above is provided with an internal frame positioned within the container. This frame includes first and second axial braces positioned in or between the sidewalls of the container. The frame is sufficiently rigid to increase the rigidity of the barrier and to strengthen the barrier against bending.

BRIEF DESCRIPTION OF THE DRAWINGS

FIG. 5 is a top view of a frame included in the barrier of FIG. 1.

FIG. 6 is a side view taken along line 6—6 of FIG. 5.

FIG. 7 is an end view taken along line 7—7 of FIG. 6.

DETAILED DESCRIPTION OF THE PRESENTLY PREFERRED EMBODIMENTS

Figure 1:
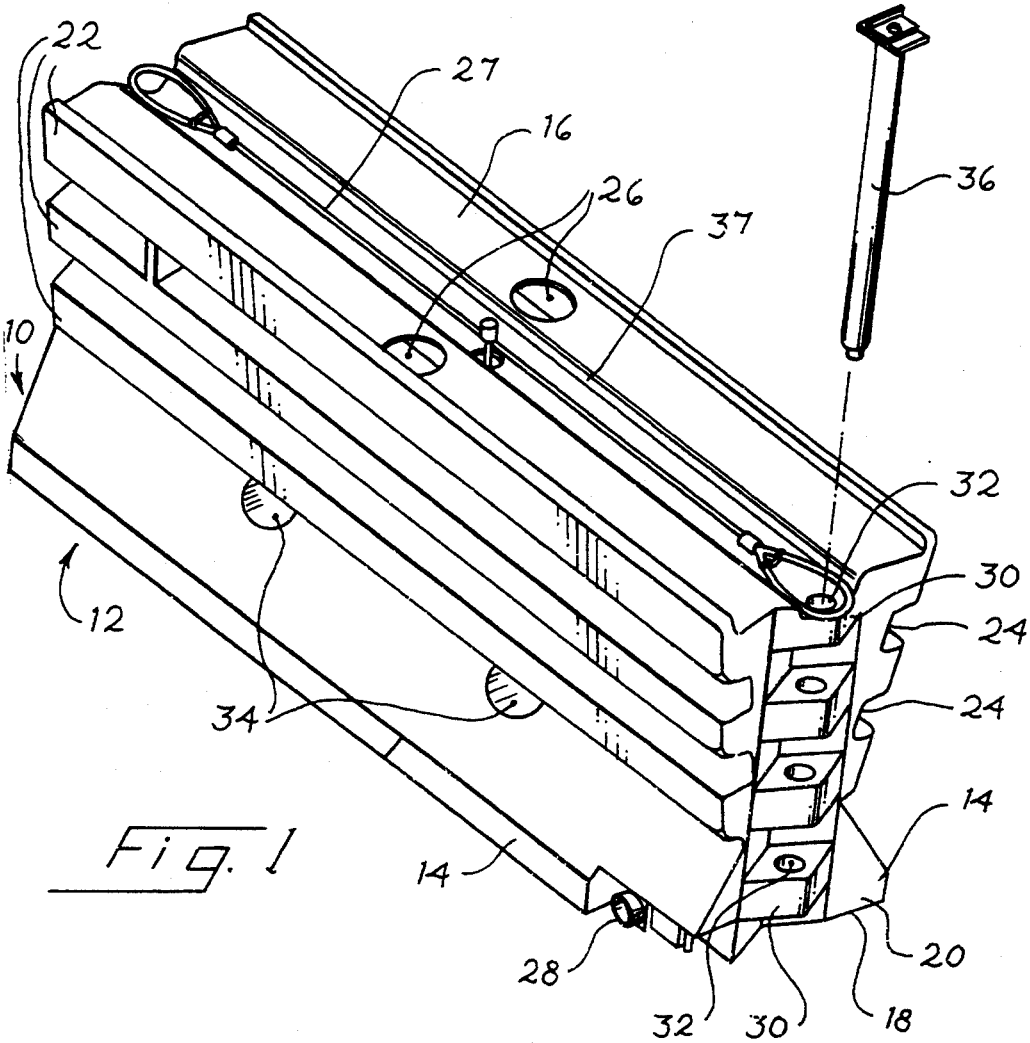
FIG. 1 is an isometric view of a roadside barrier that incorporates a first presently preferred embodiment of this invention.

Turning now to the drawings, FIGS. 1–4 show various external views of an energy absorbing roadside barrier 10 which incorporates a presently preferred embodiment of this invention. This barrier 10 includes a container 12 which is configured to stand on a support surface alongside a roadway to act as a barrier to vehicles. The container is formed as a resilient plastic shell that is molded to define a hollow internal space which is water tight and is adapted to contain a liquid such as water to increase the mass of the barrier 10.

The container 12 defines two sidewalls 14, a top wall 16, a bottom wall 18, and two end walls 20. Each of the sidewalls 14 defines three parallel ridges 22 separated by channels 24. The ridges 22 and channels 24 extend axially along the length of the container 12. The sidewalls 14 additionally define forklift ports 34 designed to receive the forks of a forklift to allow the barrier 10 to be transported easily. Each of the sidewalls 14 defines a respective drain 28 to allow water to be drained from the container 12. For example, each drain can include a gate valve that selectively closes a 1½ inch tube.

The top wall 16 defines two fill openings 26 which can be plugged with a cap after the container 12 has been filled with water. The top wall 16 also defines an axially extending recess 37 designed to receive a steel cable 27 extending between the mounting elements 30 at each end of the container 12 to provide longitudinal reinforcement to the barrier 10. This cable 27 is preferably provided with pin receiving openings to receive a pin 36, in a manner similar to that described in the above referenced U.S. Pat. No. 4,681,302.

Figure 3:
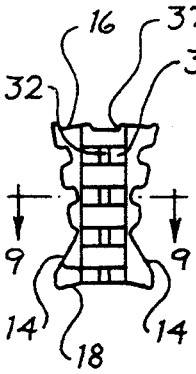
FIG. 3 is an end view taken along line 3—3 of FIG. 2.
Figure 2:
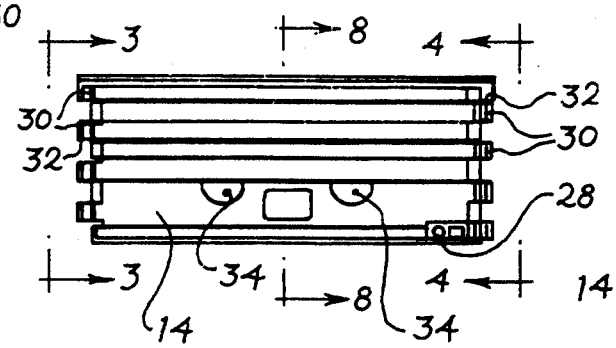
FIG. 2 is a side view of the barrier of FIG. 1.
Figure 4:
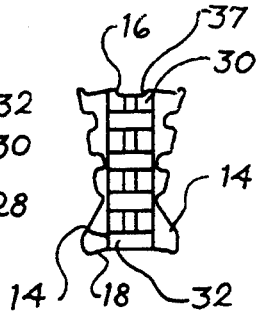
FIG. 4 is an end view taken along line 4—4 of FIG. 2.

Each of the end walls 20 defines four mounting elements 30 that protrude outwardly as shown in FIG. 2. The mounting elements 30 each define a respective pin receiving opening 32, and the openings 32 are aligned vertically. As best shown in FIGS. 2–4, the mounting elements 30 on one end of the container 12 are staggered with respect to the mounting elements 30 on the other end of the container 12. With this arrangements multiple containers 12 identical to that shown in FIGS. 1–4 can be positioned end-to-end with the mounting elements 30 of one container 12 overlying the mounting elements 30 of another adjacent container 12. Then a pin 36 can be positioned through the pin receiving openings 32 in order to secure the adjacent containers 12 together to form a continuous length of barriers.

The features of the barrier 10 described above are conventional and similar to the corresponding features of the above-identified Thompson U.S. Pat. No. 4,681,302. This patent is hereby incorporated by reference in its entirety for its description of further features of containers suitable for use in the barrier 10.

According to this invention, the barrier 10 also includes an internal frame 38 as shown in FIGS. 5–7. The frame 38 is preferably rigid and formed of elongated metal elements such as steel angles and flat bars. Preferably, the frame 38 is more rigid than the container 12, such that the frame 38 strengthens and rigidifies the container 12 as described below.

The frame 38 of this preferred embodiment includes two spaced, parallel axial braces 40 which are interconnected by two spaced, parallel cross braces 42 to form a rigid structure. Two upright braces 44 are secured, as for example by welding, to each of the axial braces 40, and as best shown in FIG. 7 the upright braces 44 diverge upwardly.

As best shown in FIGS. 5 and 7, end braces 46 are provided at each end of the frame 38. Each of the end braces 46 comprises a set of steel tubes 47, which in turn receive and retain the ends of respective steel cables 49. The cables 49 are each positioned to fit around a respective one of the pin receiving openings 32 (FIG. 1). Note that the cables 49 are offset on one end of the frame 38 with respect to the other. In particular, one end of the frame 38 defines two cables 49 which are secured to the respective tubes 47, while the other end of the frame 38 defines a single cable 49 which is secured to the respective tubes 47. If desired, the frame 38 can include diagonal braces (not shown) to provide increased rigidity to the frame 38. Bolts may be mounted in the upright braces 44 to secure the frame 38 to the sidewalls 14.

Figure 8:
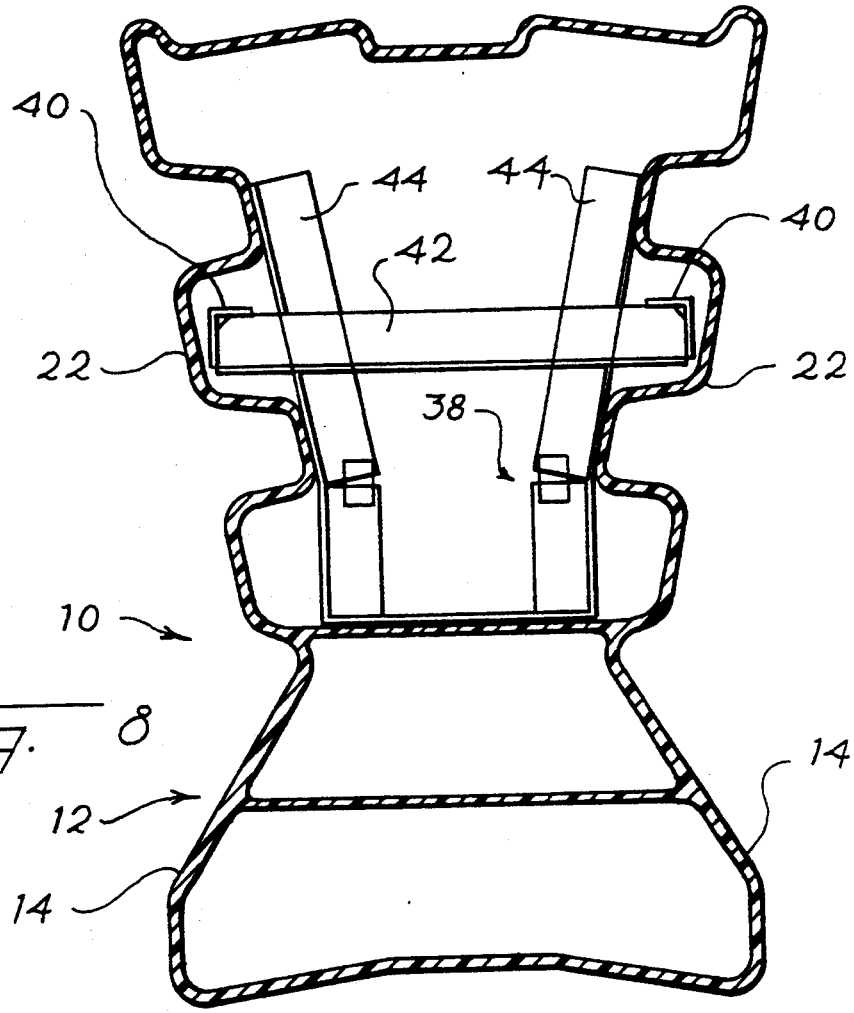
FIG. 8 is a cross-sectional view taken along line 8—8 of FIG. 2 showing the frame of FIGS. 5–7 positioned within the container of FIGS. 1–4.

FIG. 8 shows a cross-sectional view of the frame 38 within the container 12. As shown in FIG. 8, the axial braces 40 are received within respective ridges 22 in the sidewalls 14, and the upright braces 44 lie alongside the sidewalls 14. Bolts secure the upright braces 44, and thereby the frame 38, to the sidewalls 14. Preferably, the frame 38 is positioned with the axial braces 40 approximately 20 inches above the bottom wall 18. At this height, the frame 38 is positioned at or near the height of the center of gravity of a typical passenger car.

Figure 9:
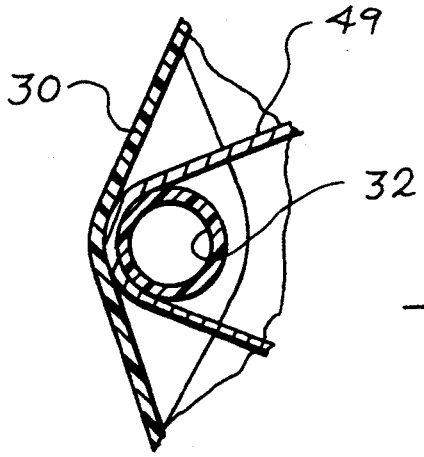
FIG. 9 is a fragmentary enlarged cross-sectional view taken along line 9—9 of FIG. 3.

FIG. 9 shows the manner in which one of the cables 49 is positioned to surround the pin receiving opening 32. As shown in FIG. 9, the cable 49 passes between the pin receiving opening 32 and the outer wall of the mounting element 30. With this arrangement, a pin positioned in the pin receiving opening 32 links the frames 38 of adjacent barriers 10 together, while simultaneously linking the containers 12 of adjacent barriers 10 together.

Simply by way of example and in order to define the best mode of this invention, the following details of construction are provided. It should be clearly understood, however, that these details of construction are not intended to limit the scope of this invention. In this embodiment the container 12 is molded from a plastic material such as low cost, medium density polyethylene which is not cross linked. The material supplied by Schulman as resin 8461 has been found suitable. The length of the container 12 is approximately 6½ feet, and the overall height of the container is 32¾ inches. The overall width of the container is about 21½ inches. Conventional molding techniques can be used to mold the container 12 in one piece around the frame 38. Because the frame 38 is preferably not heated greatly in the molding process, the frame 38 is not bonded to the container 12, and the sidewalls 14 remain free to move relative to the frame 38.

The components of the frame 38 can be formed of a metal such as ASTMA-36 or AISI M-1020 steel. Simply by way of example, the axial braces 40 can be angles measuring 2 inches by 1½ inch in cross section with a wall thickness of ⅛ inch. The cross braces 42, the upright braces 44 and the end braces 46 can be angles measuring 2 inches by 2 inches in cross section with a wall thickness of ⅛ inch. The frame 38 can be welded together so as to be completely prefabricated before the container 12 is molded around the frame 38.

The barrier 10 described above provides a number of significant advantages. It is formed of relatively low cost materials, even though it is longer in length than the prior art energy absorbing barrier described above, For these reasons, the barrier 10 can be constructed at an attractive price.

Additionally, the internal frame 38 stiffens the sidewalls 14 so that they provide more resistance to the tendency of an impacting vehicle to move into the container 12 and to form a so called "pocket". In this way any tendency of an impacting vehicle to snag on the container 12 is reduced, Furthermore, the frame 38 including the upright braces 44 strengthens the upper central portion of the barrier 10 against torsion. Additionally, the frame 38 transfers loads from one barrier to an adjacent barrier via the end braces 46 interlocked via the pins 36. All of this is achieved in a light weight structure.

All of these advantages are obtained while largely preserving the advantages of the barrier of the above-identified Thompson patent. Because the sidewalls 14 are not bonded to the frame 38, the sidewalls 14 can still develop the traveling wave described in the Thompson patent to slow an impacting vehicle.

Figure 10:
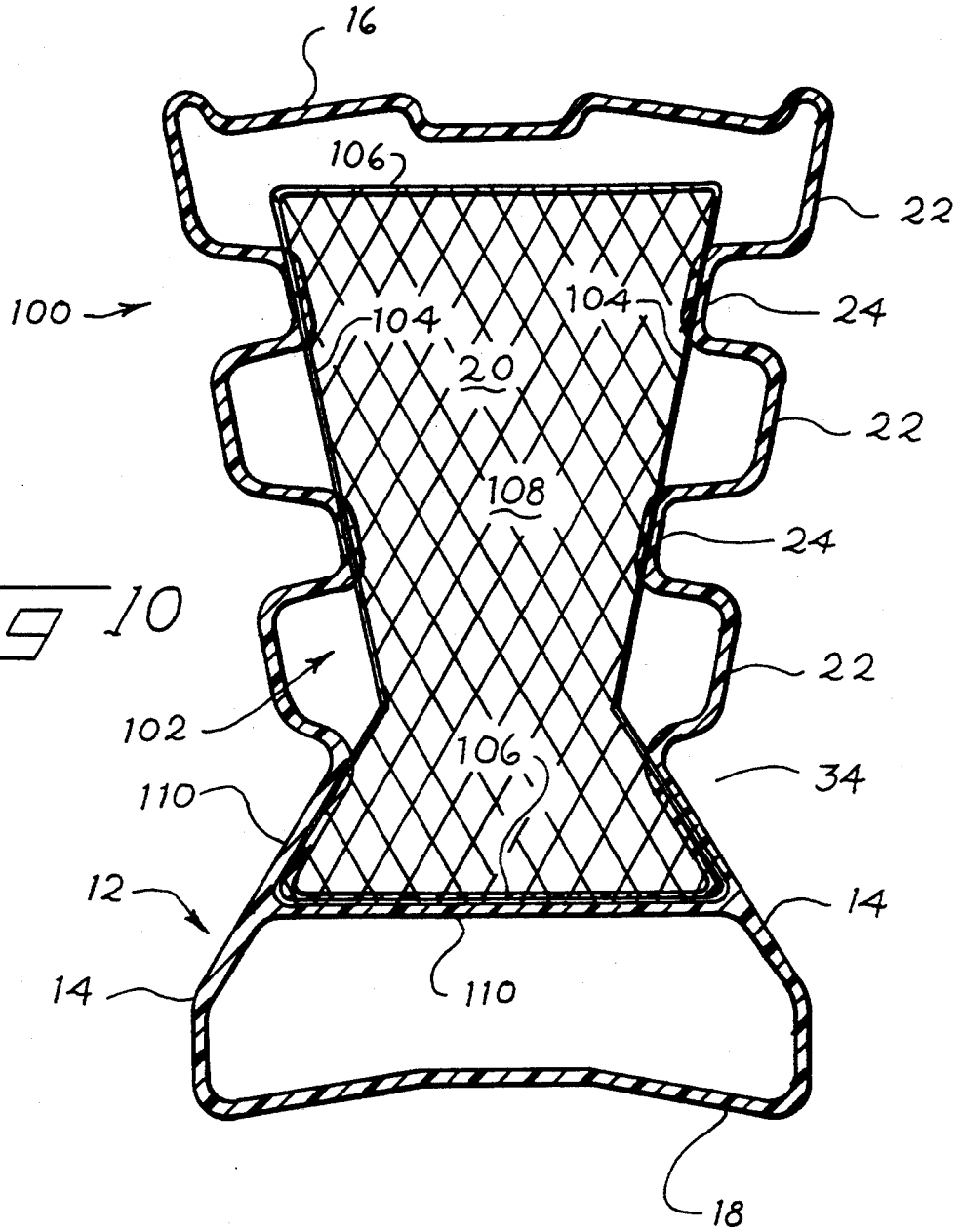
FIG. 10 is a cross sectional view of a roadside barrier that incorporates a second preferred embodiment of this invention.
Figure 11:
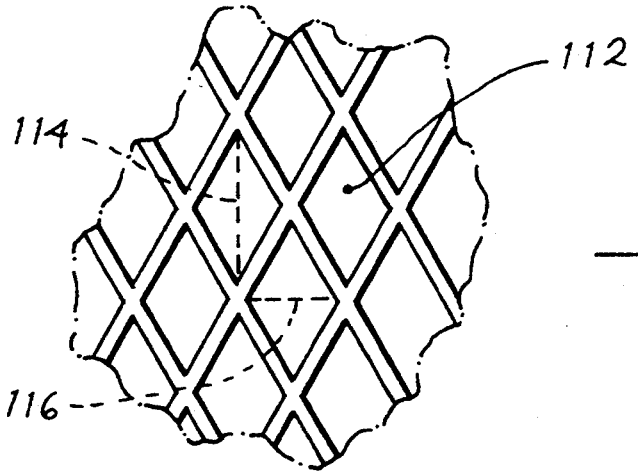
FIG. 11 is a fragmentary view of a portion of a sheet of expanded metal included in the embodiment of FIG. 10.
Figure 12:
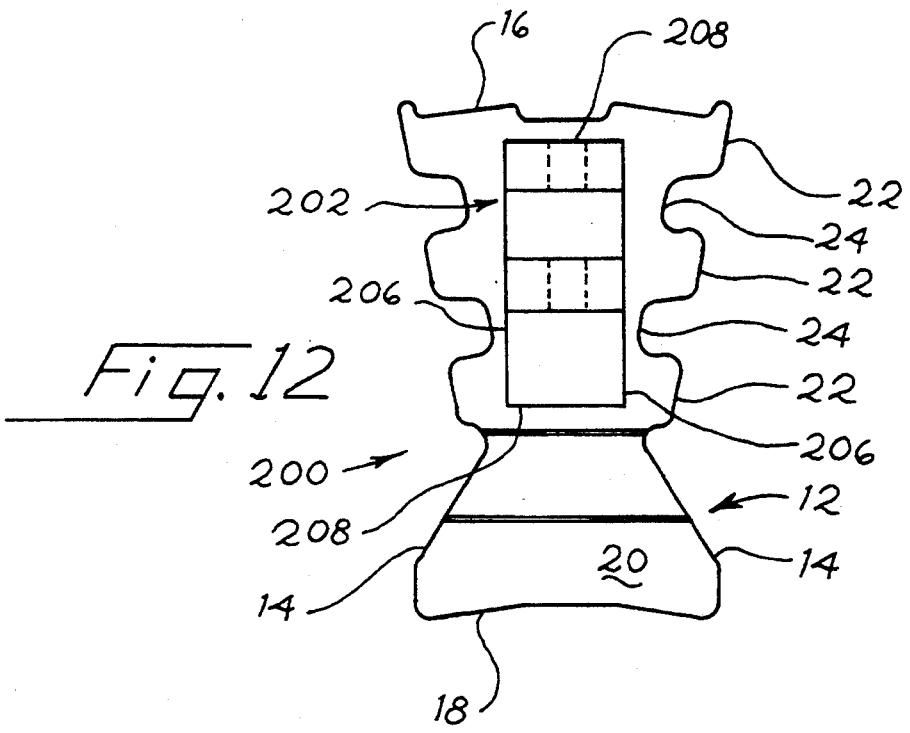
FIG. 12 is a cross sectional view of a roadside barrier that incorporates a third preferred embodiment of this invention.
Figure 13:
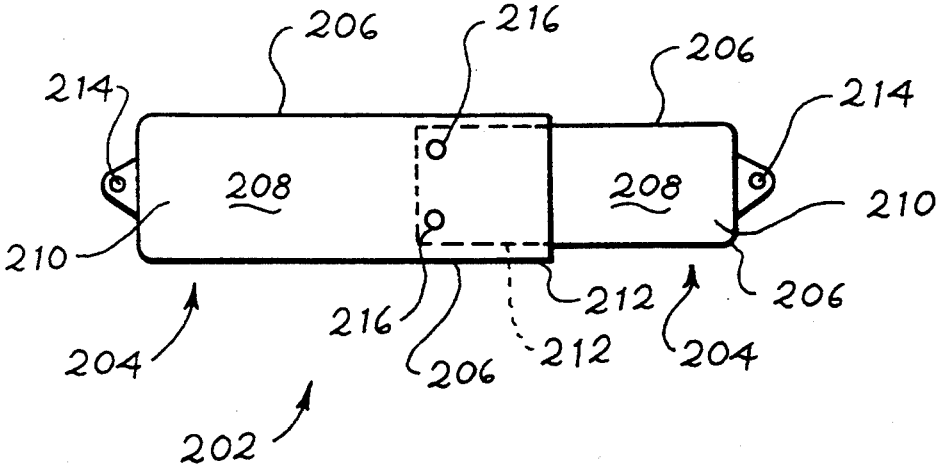
FIG. 13 is a top view of the internal frame included in the embodiment of FIG. 12.

Returning to the drawings, FIGS. 10 and 11 relate to a barrier 100 which incorporates a second preferred embodiment of this invention and FIGS. 12 and 13 relate to a barrier 200 which incorporates a third preferred embodiment of this invention.

Both of the barriers 100 and 200 include a container 12 which is identical to that discussed above in conjunction with FIGS. 1 through 4. As explained above, each of the containers 12 includes a pair of sidewalls 14, a top wall 16, a bottom wall 18 and a pair of end walls 20. The sidewalls 12 each define an axially extending array of ridges 22 separated by channels 24. Though not shown in FIGS. 10 through 13, the end walls 20 define mounting elements identical to the mounting elements 30 discussed above in conjunction with FIGS. 1 through 4.

FIG. 10 is a cross section of the barrier 100 showing an internal frame 102 which in this embodiment is a substantially rectangular shell comprising axial braces 104, cross braces 106, and end braces 108.

The axial braces 104 and the cross braces 106 are secured together as shown in FIG. 1 to form a box section. Each of the axial braces 104 is embedded in a respective sidewall 14, the upper cross brace 106 may be embedded in the top wall 16, and the lower cross brace 106 is in embedded in an additional wall 110 that is formed by the forklift port 34. The end braces 108 are secured to the axial braces 104 and the cross braces 106, and the end braces 108 are embedded in the respective end walls 20.

The braces 104, 106, 108 are in this embodiment formed of expanded metal which is suspended from the sidewall of the mold and molded into the plastic container 12 during the molding process. FIG. 11 is a fragmentary view of a portion of one of the sheets of expanded metal. As shown in FIG. 11, the expanded metal sheet defines an array of openings 112, and each of the openings defines a larger major axis 114 and a smaller minor axis 116. In this embodiment, the major axes 114 are oriented vertically in the axial braces 104 when the barrier 100 is positioned alongside a roadway, and the major axes 114 are oriented parallel to the end wall 20 in the cross braces 106. This arrangement allows the expanded metal to contract with the plastic container 12, as the plastic container 12 cools during the molding process. This arrangement also reduces the stiffness of the barrier 100 against axially oriented compression forces, which prevents the barrier 100 from spearing an impacting vehicle.

The internal frame 102 strengthens the barrier 100 against bending. In particular, because the axial braces 104 are embedded in the sidewalls 14 at the base of the channels 24, the axial braces 104 extend across the ridges 22, and form box sections with the walls of the ridges 22. In this way, the axial braces 104 substantially stiffen the ridges 22 against bending. Furthermore, the cross braces 106 cooperate with the axial braces 104 to form a large box section which further stiffens the barrier 100 against bending.

The expanded metal is in part exposed to water and should preferably be formed of galvanized steel or aluminum. In alternative embodiments, the internal frame 102 can be constructed of differing materials, such as composites of elongated fibers embedded in a resin matrix. For example, various resin impregnated fabrics can be used, or various fabrics can be molded directly into the walls of the container 12.

Turning now to FIGS. 12 and 13, the barrier 200 includes an internal frame 202 that in turn includes first and second beams 204. Each of the beams 204 comprises a pair of spaced axial braces 206 interconnected by upper and lower cross braces 208. The axial braces 206 and the cross braces 208 are secured together to form a box section.

Each of the beams 204 defines an outer end 210 and an interior end 212. The outer ends 210 define respective loops 214 which fit around the pin receiving openings of the mounting elements of the respective end walls 20. The interior ends 212 are coupled together for sliding movement. This can be accomplished for example by fitting one interior end 212 inside the other, as shown in FIG. 13. One or more fasteners 216 are provided to immobilize the first and second beams 204 against relative sliding movement.

The internal frame 202 is incorporated in the barrier 200 by first suspending the internal frame 202 within a mold and then molding container 12 around the internal frame 202. Initially, the fasteners 216 are not installed, to allow relative sliding movement between the beams 204. When the container 12 cools during the molding process, it will shrink substantially, typically by two to three inches in this preferred embodiment. The relative sliding movement between the interior ends 212 accommodates this contraction of the container 12. Once the container 12 has contracted, the fasteners 216 are installed to prevent further sliding movement between the beams 204. Once the fasteners 216 are tightened, the interior frame 202 substantially reduces or eliminates stretching of the barrier 200 between the end walls 20 and stiffens the barrier 200 against bending. Forces applied to one of the barriers 200 are efficiently transferred to additional barriers in the direction of travel of an impacting vehicle in order to cause the barriers to cooperate as a unit.

The internal frame 202 can be made for example of sheet metal such as galvanized steel which is secured together, as for example, by riveting. The fasteners 216 can be embodied as a wide range of alternative structures, including threaded fasteners, rivets, welds, adhesive fasteners, as well as various latches and ratchet mechanisms.

The axial braces 206 of the interior frame 202 are preferably mounted alongside and adjacent to the respective sidewalls 14, thereby stiffening the sidewalls 14 against an impact. It will be understood that though the braces 206, 208 have been identified as separate elements, they can, if desired, correspond to respective parts of an extruded section.

Because the internal frame 202 is a box frame design and generally tubular in shape, it can be formed of lightweight materials. In this preferred embodiment, the internal frame 202 is about 6½ feet in length and lightweight, i.e., less than 30 pounds in weight. By way of example, the interior frame 202 can be about 12 inches in height and of an appropriate width to extend between the sidewalls 14.

Figure 14:
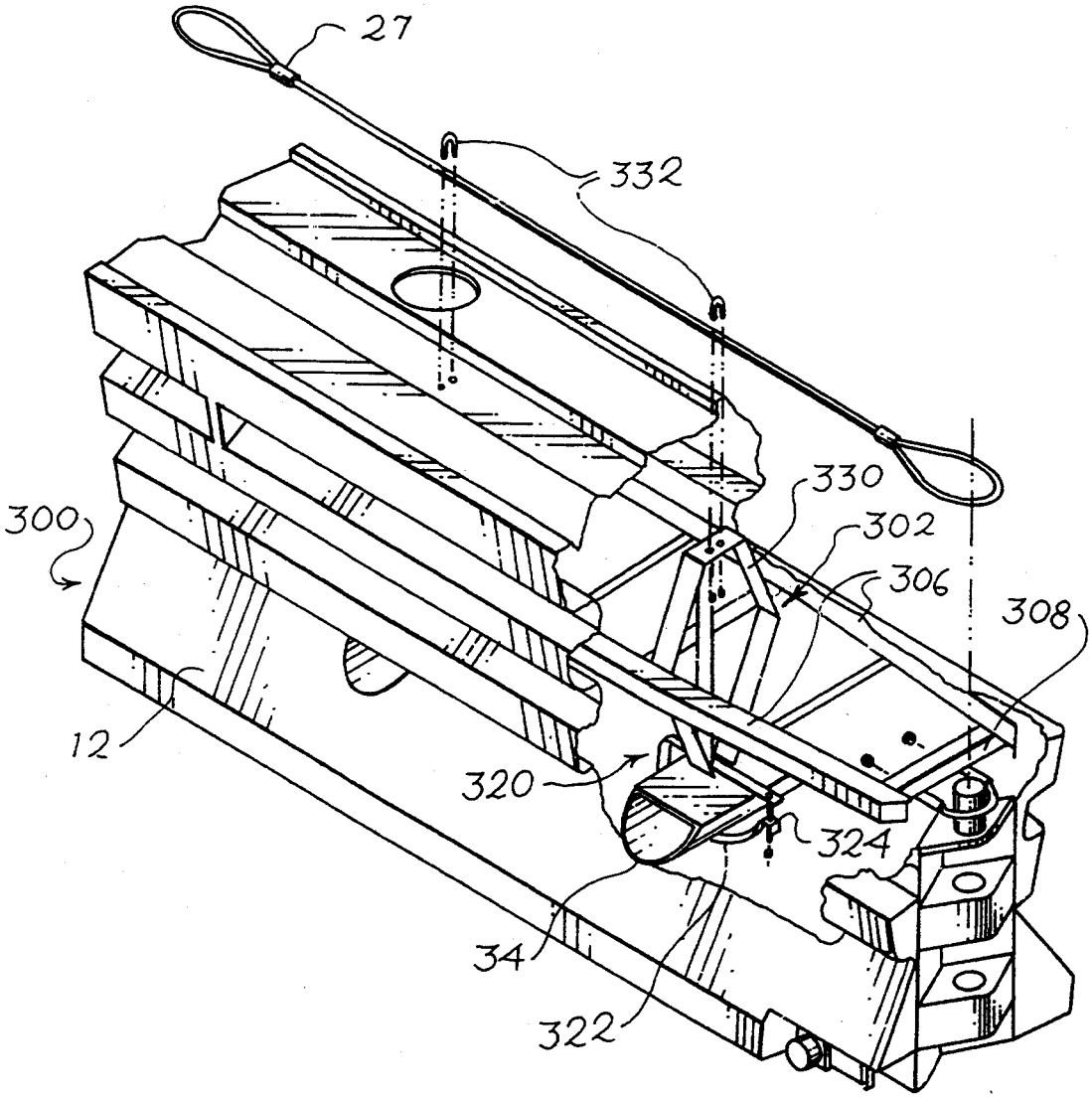
FIG. 14 is an exploded perspective view in partial cutaway showing another embodiment of the present invention.
Figure 15:
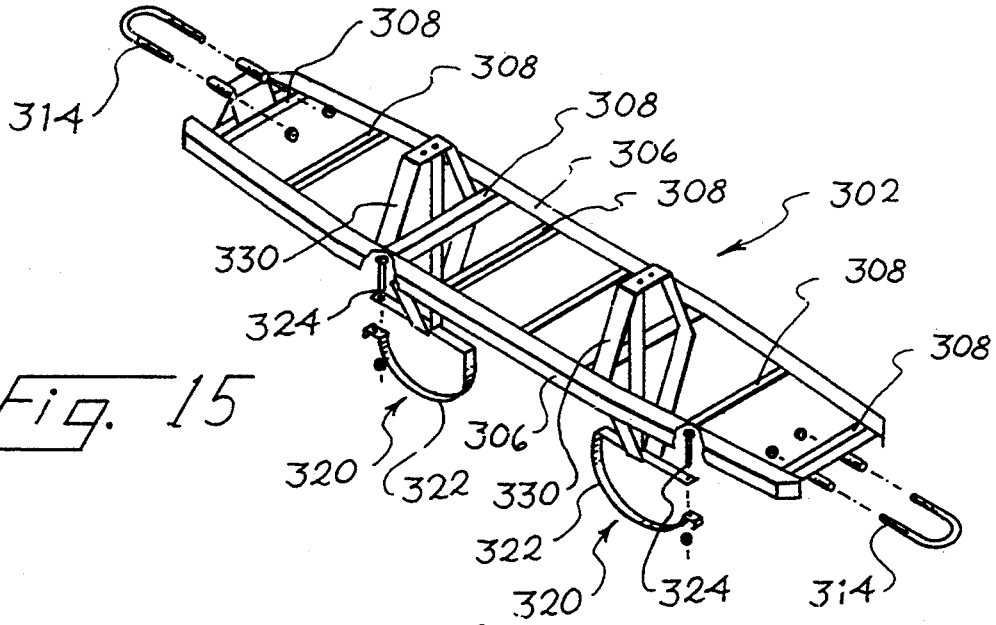
FIG. 15 is an exploded perspective view of the frame of FIG. 14.
Figure 16:
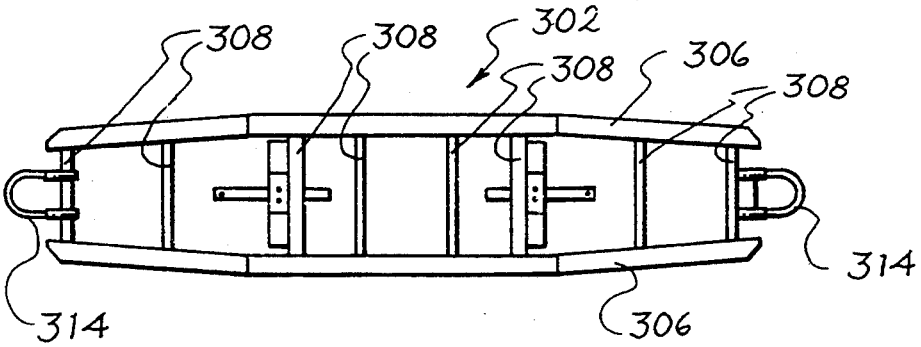
FIG. 16 is a top plan view of the frame of FIG. 15.

FIGS. 14–17 illustrate another barrier 300 built in accordance with this invention. The barrier 300 includes an internal frame 302, and the internal frame 302 includes two spaced axial braces 306 secured together by cross braces 308 to form a rigid structure (FIGS. 15 and 16). U bolts 314 are positioned at each end to link adjacent internal frames 302 together as described above.

As best shown in FIGS. 14 and 15, the internal frame 302 includes a pair of lower attachment structures 320, each comprising a D-shaped band 322 and a bolt 324. As shown in FIG. 14, the lower attachment structures 320 secure the internal frame 302 around the forklift ports 34. In addition, the internal frame 302 includes a pair of upper attachment structures 330. Each of these upper attachment structures 330 is secured to the cable 27 by a suitable U bolt 332.

Figure 17:
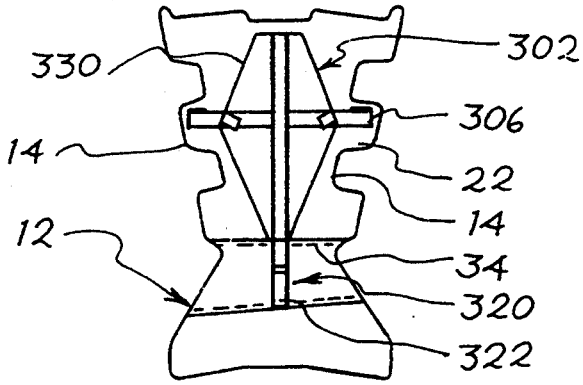
FIG. 17 is a cross sectional view of the embodiment of FIG. 14.

As best shown in FIG. 17, the axial braces 306 are disposed within the respective ridges 22, and the lower and upper attachment structures 320, 330 secure the internal frame 302 in the container 12 at points spaced from the side walls 14. These features effectively reduce any tendency of the internal frame 302 to be lifted within the container 12 in an impact. Lifting forces imparted to the internal frame 302 are transmitted effectively to the container 12 to ensure that the entire mass of the container 12 and its contents has an early effect in retarding the impacting vehicle. The disclosed structure provides excellent pocket resistance to an impacting vehicle and excellent stability of the internal frame 302 about a rotational axis while eliminating the need for side wall fastening.

Simply by way of example, the axial braces 206 can be formed of angle iron (1½ inch by 2 inch by ⅛ inch), the cross braces can be formed of angle iron (1½ inch by 1½ inch by ⅛ inch for the wider cross braces and 1 inch by 1 inch by ⅛ inch for the narrower cross braces), and the attachment structures 320, 330 can be formed of flat bar steel (1 inch by ⅛ inch for the wider elements and ½ inch by ⅛ inch for the narrower elements). A resin such as a low, medium or high density polyethylene, depending on cost, is suitable for use in the container 12, and the internal frame 202 can be rotationally molded in place within the container 12 in the conventional manner. A suitable resin is Schulman 8461, which can be colored as appropriate.

It should be appreciated that a wide range of changes and modifications can be made to the preferred embodiments described above. For example, the configuration of the container can be altered to suit the application, and the container does not require the above described channels and ridges in all cases. The internal frames can be formed with other geometries, as long as they provide the rigidifying function described above. In addition, materials can all be selected as appropriate for the particular application.

It is the following claims, including all equivalents, which are intended to define the scope of this invention.

We claim:

1. In a roadside barrier of the type comprising an elongated container receiving and holding a volume of a fluent material which is non-setting at room temperature, said container comprising a pair of side walls, said side walls having sufficient rigidity to allow the container to stand alongside a roadway and sufficient resilience to deform upon an impact by a vehicle to create a travelling wave to slow the vehicle and to recover their shape after at least some impacts; the improvement comprising:

an internal frame positioned within the container, said frame comprising first and second axial braces positioned within the container, said axial braces secured together by at least one cross brace, said braces formed of rigid elements which cooperate to form a rigid structure; said frame and container formed of different materials, said frame increasing the rigidity of the barrier to strengthen the barrier against bending.

2. In a roadside barrier of the type comprising an elongated container configured to receive and hold a volume of fluent material, said container comprising a pair of side walls, said side walls having sufficient rigidity to allow the container to stand alongside a roadway and sufficient resilience to deform upon an impact by a vehicle and to recover their shape after at least some impacts; the improvement comprising:

an internal frame positioned within the container, said frame comprising:

first and second axial braces positioned adjacent respective side walls of the container;

first and second cross braces, each secured between the first and second axial braces to create a rigid structure;

first and second upright braces secured to the rigid structure adjacent the first and second cross braces, respectively, at an angle to the axial braces to lie alongside the side walls; and first and second tapered end braces, each having a narrower portion extending away from the axial braces and a wider portion secured to the rigid structure near the axial braces.

3. In a roadside barrier of the type comprising an elongated container configured to receive and hold a volume of fluent material, said container comprising a pair of side walls, said side walls having sufficient rigidity to allow the container to stand alongside a roadway and sufficient resilience to deform upon an impact by a vehicle and to recover their shape after at least some impacts, at least one of said side walls defining an array of axially extending ridges separated by axially extending channels; the improvement comprising:

an internal frame positioned within the container, said frame comprising:

first and second axial braces positioned adjacent to and secured to respective side walls of the container;

said first axial brace secured to the side walls at the channels to extend across at least one of the ridges such that the axial brace and the ridge form a box section, thereby increasing the rigidity of the ridge and strengthening the barrier against bending.

4. In a roadside barrier of the type comprising an elongated container configured to receive and hold a volume of fluent material, said container comprising a pair of side walls, said side walls having sufficient rigidity to allow the container to stand alongside a roadway and sufficient resilience to deform upon an impact by a vehicle and to recover their shape after at least some impacts, said container further comprising a pair of end walls, each comprising at least one mounting element configured to secure the container to another similar container; the improvement comprising:

an internal frame positioned within the container, said frame comprising:

first and second beams, each comprising a pair of axial braces and a pair of cross braces arranged in a box section, each beam defining an outer end secured to at least one mounting element on the respective end wall and an interior end, said interior ends coupled together to allow sliding movement over at least a selected distance; and at least one fastener secured to the interior ends to immobilize the interior ends against relative sliding movement.

5. In a roadside barrier of the type comprising an elongated container configured to receive and hold a volume of fluent material, said container comprising a pair of side walls, said side walls having sufficient rigidity to allow the container to stand alongside a roadway and sufficient resilience to deform upon an impact by a vehicle and to recover their shape after at least some impacts; the improvement comprising:

an internal frame positioned within the container, said frame comprising first and second axial braces positioned within the container, said axial braces secured together by at least one cross brace, said frame and container formed of different materials, said frame increasing the rigidity of the barrier to strengthen the barrier against bending;

wherein each of the side walls defines a respective outwardly extending ridge oriented along a length direction of the container, and wherein each of the axial braces is positioned at least partly within a respective one of the ridges.

6. In a roadside barrier of the type comprising an elongated container configured to receive and hold a volume of fluent material, said container comprising a pair of side walls, said side walls having sufficient rigidity to allow the container to stand alongside a roadway and sufficient resilience to deform upon an impact by a vehicle and to recover their shape after at least some impacts; the improvement comprising:

an internal frame positioned within the container, said frame comprising first and second axial braces positioned within the container, said axial braces secured together by at least one cross brace, said frame and container formed of different materials, said frame increasing the rigidity of the barrier to strengthen the barrier against bending;

wherein the axial braces each comprise a respective portion of expanded metal.

7. The invention of claim 2 wherein each of the side walls defines a respective outwardly extending ridge oriented along a length direction of the container, and wherein each of the axial braces is positioned at least partly within a respective one of the ridges.

8. The invention of claim 5 or 7 wherein the container defines a bottom wall configured to rest on a support surface, and wherein the frame is spaced above the bottom wall, suspended by the ridges.

9. The invention of claim 1 wherein the container defines first and second ends, wherein each of the ends comprises a respective mounting element configured to secure the container to another similar container, and wherein the frame defines first and second tapered end braces, each end brace having a narrower portion adjacent the respective end of the container and a wider portion adjacent the axial braces.

10. The invention of claim 2 wherein the container defines first and second ends, wherein each of the ends comprises a respective mounting element configured to secure the container to another similar container, and wherein the frame is coupled to the first and second ends near the mounting elements.

11. The invention of claim 9 or 10 wherein each of the mounting elements defines a respective pin receiving opening, and wherein each of the end braces extends around the respective pin receiving opening.

12. The invention of claim 1 wherein the frame further comprises a plurality of upright braces positioned at an angle to the axial braces to lie alongside the side walls.

13. The invention of claim 2 or 12 wherein the upright braces are oriented to diverge upwardly.

14. The invention of claim 3 wherein the axial braces each comprise a respective portion of expanded metal.

15. The invention of claim 6 or 14 wherein each portion of expanded metal defines an array of openings, wherein each opening defines a longer major axis and a shorter minor axis, and wherein the major axes are oriented vertically when the barrier is oriented to stand alongside a roadway.

16. The invention of claim 1 or 3 wherein the axial braces are embedded in the sidewalls at least in part.

17. The invention of claim 3 wherein the frame further comprises a pair of cross braces secured between the axial braces.

18. The invention of claim 17 wherein the other of the cross braces is at least in part embedded in an additional wall of the container extending between the side walls.

19. The invention of claim 18 wherein the container further comprises a pair of end walls, each comprising at least one mounting element configured to secure the container to another similar container, and wherein the frame further comprises a pair of end braces, each secured to the side braces and the cross braces and embedded in the respective end wall.

20. The invention of claim 4 wherein each of the mounting elements defines a respective pin receiving opening, and wherein each of the outer ends extends around the respective pin receiving opening.

21. The invention of claim 1 or 2 or 3 or 4 wherein the container is formed of a plastic material and is filled with a liquid consisting essentially of water.

22. The invention of claim 1 or 2 or 3 or 4 wherein the container is molded around the frame.

23. The invention of claim 1 or 2 or 3 or 4 wherein at least some of the braces of the frame comprise metallic elements, and wherein the container is formed from a plastic material.

24. The invention of claim 1 or 2 or 3 or 4 wherein the frame is more rigid than the container with respect to compressive forces applied to one of the side walls toward the other of the side walls.

* * * * *